United States Patent [19]

Teutsch

[11] 3,982,647

[45] Sept. 28, 1976

[54] LIFT TRUCK FOR CONCRETE BLOCKS

[75] Inventor: Edward G. Teutsch, Willoughby, Ohio

[73] Assignee: Towmotor Corporation, Mentor, Ohio

[22] Filed: Apr. 28, 1975

[21] Appl. No.: 572,245

[52] U.S. Cl. ..... 214/750; 214/731; 294/67 A

[51] Int. Cl.[2] ..... B66F 9/14

[58] Field of Search ..... 294/63 R, 67 R, 67 A, 294/67 AA, 67 AB, 82 R, 103 CG; 214/620, 621, 650 R, 651, 652, 731, 750, DIG. 3

[56] References Cited

UNITED STATES PATENTS

| | | | |
|---|---|---|---|
| 2,581,364 | 1/1952 | Cushman | 294/67 A X |
| 2,987,339 | 6/1961 | Kaplan et al. | 294/67 A |
| 3,258,287 | 6/1966 | Crosby | 294/67 AA |
| 3,289,873 | 12/1966 | Hansen | 214/731 UX |
| 3,484,851 | 12/1969 | Houseman et al. | 214/731 |
| 3,589,541 | 6/1971 | Melin | 214/731 |
| 3,817,567 | 6/1974 | Lull | 214/731 X |

FOREIGN PATENTS OR APPLICATIONS

| | | | |
|---|---|---|---|
| 232,435 | 7/1963 | Austria | 214/731 |
| 871,409 | 6/1961 | United Kingdom | 294/103 CG |

*Primary Examiner*—Johnny D. Cherry
*Attorney, Agent, or Firm*—Phillips, Moore, Weissenberger, Lempio & Strabala

[57] ABSTRACT

A carriage assembly for a lift truck includes one or more load supporting forks attached thereto, each fork being L-shaped and having an undercut intersection between its vertical and horizontal legs to permit simultaneous engagement of the vertical and horizontal legs with right angle surfaces of a load, the horizontal leg having a forwardly projecting tip formed with a spherical configuration to facilitate engagement of the fork with the load, the load supporting fork being particularly contemplated for use with concrete blocks or the like which may be subject to damage.

8 Claims, 2 Drawing Figures

LIFT TRUCK FOR CONCRETE BLOCKS

BACKGROUND OF THE INVENTION

The present invention relates to a carriage assembly for lift trucks and more particularly to a load supporting fork configuration selected for handling angularly shaped loads or objects which may be formed from friable or other materials subject to damage during handling.

Load supporting forks for lift trucks and the like are generally formed in an L-shaped configuration from rectangular bar stock, the L-shaped forks being adapted for mounting upon a lift truck carriage, for example. Such forks commonly include a vertical leg attachable to the carriage and a forwardly extending, horizontal leg intended to pass under or penetrate an opening in a load. It is further common in the design of lift trucks to provide means for tilting the carriage so that the forwardly projecting tips are raised in order to assure that the load is maintained upon the forks during handling. When the carriage is tilted in this manner, the load tends to be shifted rearwardly into abutting engagement with the vertical leg of each fork while also resting upon an upper surface of its forwardly extending leg.

A problem has been encountered in connection with the use of such load supporting forks, particularly when they are employed to move or handle loads subject to damage. A particular example of such a load may comprise concrete blocks which are commonly moved in stacks by lift trucks. The concrete blocks are formed with openings extending therethrough, the forks being laterally movable upon the carriage for alignment with these openings in order to thus engage and support an entire stack of blocks.

When used in this manner, conventional load supporting forks have been found capable of causing damage in at least two ways. Initially, the forwardly extending tips of conventional forks are normally shaped to have elongated laterally extending edges formed by the intersection of a tapered bottom surface of the fork and a top surface of the fork. The side surfaces of the fork may have little or no taper so that the sharp edge extends almost entirely across the lateral dimension of each fork. When the forks are engaged with the concrete blocks, the forks do not always align perfectly with the openings in the blocks so that these leading edges of the forks tend to break or chip away the friable concrete material of the blocks.

In addition, when a large stack of concrete blocks is arranged upon the load supporting forks of a lift truck carriage, certain blocks in the load tend to support a substantial portion of the load against intersecting surfaces of the vertical and forward legs of the fork. Within the prior art, this intersection of the forks has commonly been formed with a large radius fillet, commonly of concave configuration. Thus, the fillet extends outwardly from or blocks the intersection between the load supporting surfaces of the fork and tends to break or chip away friable material from the concrete block during loading and handling.

SUMMARY OF THE INVENTION

Accordingly, it is a particular object of the present invention to provide a lift truck carriage including one or more load supporting forks configured to prevent damage of the type discussed above.

It is also an object of the invention to provide L-shaped forks for use in conjunction with lift truck carriages, the L-shaped forks having a similar configuration to prevent damage of the type referred to above.

The L-shaped fork of the present invention particularly avoids the likelihood of such damage initially by forming an intersecting portion of each L-shaped fork with an undercut to permit simultaneous engagement of an angular load with both the vertical and forwardly extending legs of the fork. The forwardly projecting tip of each fork is also preferably formed with a spherical configuration to facilitate its engagement with the load.

Additional object and advantages of the invention are made apparent in the following description having reference to the accompanying drawing.

DESCRIPTION OF THE PREFERRED EMBODIMENT

Figure 1:
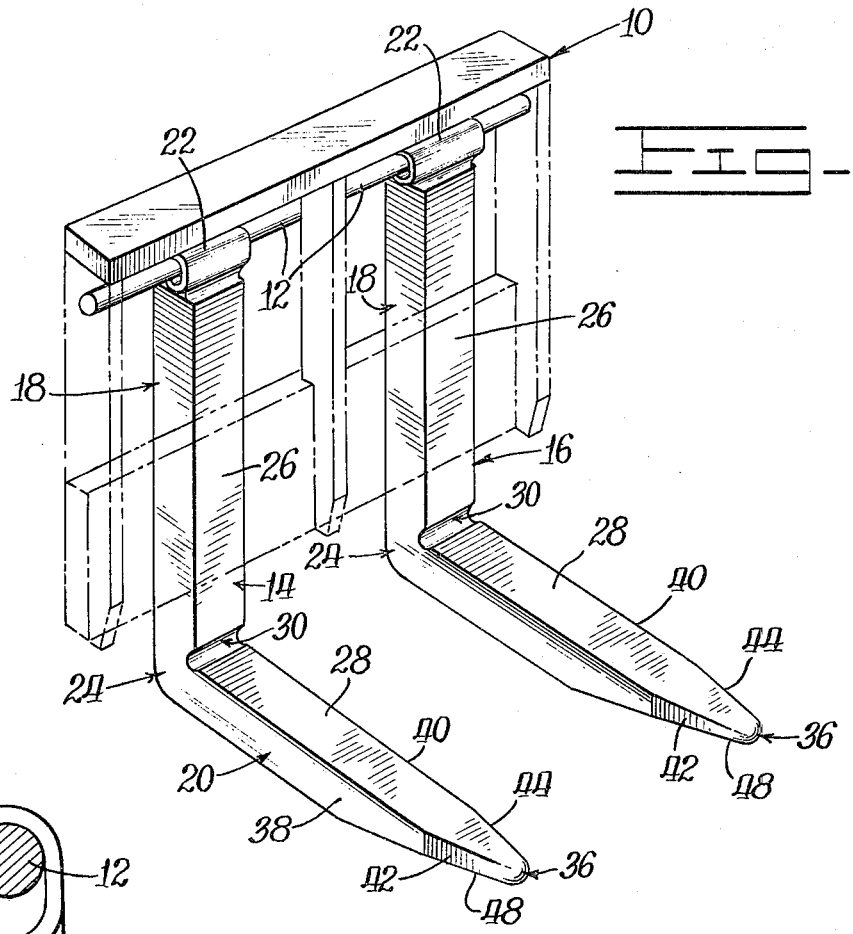
FIG. 1 is an isometric representation of a lift truck carriage including two laterally spaced forks configured according to the present invention.

A carriage assembly of the type contemplated by the present invention is generally indicated at 10 in FIG. 1. The configuration of the carriage is relatively unimportant to the present invention except for providing a mounting at the front end of a lift truck (not shown). Commonly, the carriage includes a transverse mounting means such as the bar structure indicated at 12. The transverse bar 12 provides a mounting for one or more load supporting forks of the type indicated at 14 and 16.

Figure 2:
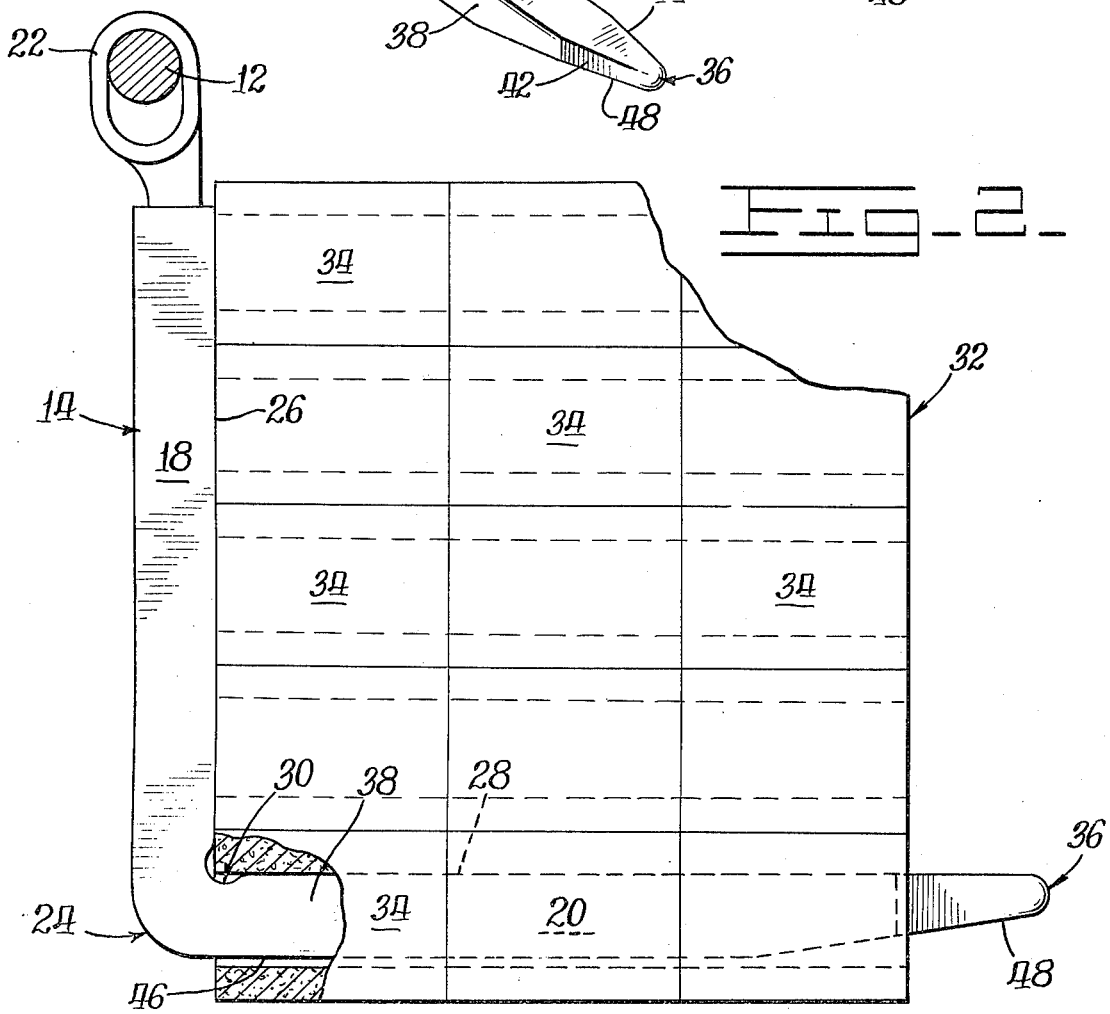
FIG. 2 is a side view illustrating the manner in which one of the load supporting forks for the carriage of FIG. 1 engages a load such as a stack of concrete blocks.

Referring also to FIG. 2, each fork is L-shaped and includes a vertical leg 18 as well as a horizontal or forwardly extending leg 20. A bracket 22 connected to the top of each fork is adapted to encompass the transverse mounting bar 12 and provide a relatively loose fitting mounting for each fork. Thus, the forks may be laterally moved upon the carriage in order to position or align them for engagement with loads of different configurations. Referring again particularly to FIG. 2, each fork includes an intersecting portion 24 arranged at the juncture between the perpendicularly arranged legs 18 and 20. The vertical leg 18 includes a flat forward surface 26 while the forwardly extending leg 20 includes a flat upper surface 28. These surfaces are intended to engage and support a load upon each fork, particularly when the lift truck carriage is tilted or "racked back" in the manner described above.

Each fork is particularly configured to avoid damage to loads composed, for example, of concrete blocks as illustrated in FIG. 2. For this purpose, the intersecting portion 24 of each fork forms an undercut indicated at 30. The undercut 30 is sufficiently deep so that the material of the intersecting fork portion 24 does not interfere with simultaneous engagement of the load, generally indicated at 32, with both of the surfaces 26 and 28. Preferably, the undercut 30 has a cylindrical configuration formed with a minimum radius of approximately ½ inch in order to minimize stress concentrations at this portion of the fork. Normally, conventional load supporting forks are formed with a large radius, concave fillet at this location to provide increased strength for the fork. However, such a conventional intersection would completely block the intersection between similar surfaces as those indicated at 26 and 28.

The advantage of the undercut 30 may be best seen in FIG. 2 by particularly noting one of the concrete blocks 34 which abuts both of the surfaces 26 and 28. The undercut configuration of the present invention permits this block to abuttingly engage both surfaces without having its angular surfaces or edges damaged by the intersecting portion of the fork.

In addition, each of the forks has a forwardly projecting tip generally indicated at 36. As was noted above, conventional tips for load supporting forks are commonly formed with a transverse edge which may tend to damage the concrete blocks or other load material when the forks are being inserted into place. For example, as may also be seen in FIG. 2, it is common to insert the forks into openings extending through the concrete blocks. If the forks are somewhat out of transverse alignment with the openings in the blocks, these conventional edges will tend to cut or otherwise damage the friable concrete in the blocks. Accordingly, the forwardly projecting tip 36 on the load supporting fork of the present invention has a spherical configuration as may be best seen by combined reference to FIGS. 1 and 2. Preferably, the top surface 28 for each fork extends forwardly to the spherical tip 36. Referring particularly to FIG. 1, it may be seen that side surfaces 38 and 40 for each tip have angularly tapered surfaces 42 and 44 respectively which approach the spherical tip 36. Similarly, having particular reference to FIG. 2, it may be seen that a bottom surface 46 for each fork also has a similar angularly tapered surface 48 which approaches the spherical tip 36. This configuration for the forwardly extending tip of each fork tends to facilitate its engagement with loads comprised of materials such as concrete blocks of the type illustrated in FIG. 2.

I claim:

1. A carriage assembly for use on a lift truck, comprising a carriage including a transverse mounting bar means, and at least one load supporting fork, the fork being L-shaped and including a vertical leg having means for attachment to the transverse mounting bar means of the carriage and a horizontal leg extending forwardly from the carriage for engagement with a load, the horizontal leg having a flat upper surface arranged for supporting engagement with the load, the vertical leg having a forwardly facing surface also engagable with the load, the L-shaped fork including an angular portion arranged at an intersection between the surfaces, the intersecting portion of the fork being undercut to a depth including the right angle intersection of the surfaces so that a rectangularly shaped load may be engaged and supported in simultaneous abutting relation with both of the surfaces, the fork also including a forwardly projecting tip, the forwardly projecting tip having a spherical configuration to facilitate engagement of the fork with the load.

2. The carriage assembly of claim 2 comprising a plurality of the L-shaped forks arranged in transversely movable relation upon the transverse mounting bar means.

3. The carriage assembly of claim 1 wherein the undercut formed by the intersection portion of the fork is cylindrically shaped to minimize stress concentration within the intersecting portion of the fork.

4. The carriage assembly of claim 3 wherein the cylindrically shaped undercut is formed with a minimum radius of approximately one-half inch.

5. The carriage assembly of claim 3 wherein the top surface of the forwardly projecting leg of the fork extends forwardly to the spherically shaped tip, the forwardly extending portion of the fork having side surfaces and a bottom surface including angularly tapered surfaces extending toward the spherical tip.

6. The carriage assembly of claim 1 wherein the top surface of the forwardly projecting leg of the fork extends forwardly to the spherically shaped tip, the forwardly extending portion of the fork having side surfaces and a bottom surface including angularly tapered surfaces and a bottom surface including angularly tapered surfaces extending toward the spherical tip.

7. An L-shaped fork for use in conjunction with the carriage of a lift truck, the fork comprising a vertical leg including means for connection to the carriage, a forwardly projecting leg including a flat upper surface and tip at its forwardly projecting end, and an intersecting portion whereby the vertical and forward legs are secured in a right angle relation to each other, the vertical and forward legs having intersecting surfaces engagable with a load supported by the fork, the intersecting portion of the fork forming a cylindrical undercut arranged to include the intersection of said surfaces in order to permit simultaneous engagement of the intersecting surfaces with right angle surfaces of a load, the forwardly projecting tip of the fork having a spherical configuration to facilitate its engagement with the load.

8. The fork of claim 7 wherein the cylindrical undercut is formed with a minimum radius of approximately one-half inch, the forwardly projecting leg of the fork also including side surfaces and a bottom surface each having an angularly tapered portion extending toward the spherical tip.

* * * * *

UNITED STATES PATENT AND TRADEMARK OFFICE

CERTIFICATE OF CORRECTION

PATENT NO. : 3,982,647
DATED : Sept. 28, 1976
INVENTOR(S) : Edward G. Teutsch

It is certified that error appears in the above-identified patent and that said Letters Patent are hereby corrected as shown below:

Title Page, Section [54], should read --LIFT TRUCK FORK FOR CONCRETE BLOCKS--.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*